United States Patent [19]

Deiner et al.

[11] 4,004,059

[45] Jan. 18, 1977

[54] METHOD TO MAKE FIBROUS MATERIAL OIL AND WATER REPELLENT AT THE SAME TIME

[75] Inventors: Hans Deiner, Neusass; Bernhard Sandner, Biburg; Willy Bernheim, Diedorf, all of Germany

[73] Assignee: Ciba-Geigy Corporation, Ardsley, N.Y.

[22] Filed: Feb. 4, 1975

[21] Appl. No.: 547,078

[30] Foreign Application Priority Data

Feb. 8, 1974 Germany ..... 2406002

[52] U.S. Cl. ..... 428/224; 260/2 S; 427/387; 427/390 E; 428/266; 428/321; 428/391; 428/422

[51] Int. Cl.[2] ..... D06M 13/18

[58] Field of Search ..... 260/2 S, 827; 427/387, 427/390; 428/224, 266, 321, 341, 391, 422, 405, 429, 447

[56] References Cited

UNITED STATES PATENTS

| | | | |
|---|---|---|---|
| 3,378,609 | 4/1968 | Fasick et al. | 260/827 |
| 3,385,812 | 5/1968 | Brachman | 260/827 |

*Primary Examiner*—John H. Newsome
*Attorney, Agent, or Firm*—Joseph G. Kolodny; Edward McC. Roberts; Prabodh I. Almaula

[57] ABSTRACT

While good oil-repellency can be imparted to fibre materials by treating them with polymers containing perfluoralkyl groups, it is difficult to impart water-repellency to the fibre materials at the same time and also give the treated materials a good handle. This is achieved by treating the fibre materials with, besides the perfluoralkyl group-containing polymers, an addition product of a) an unsaturated compound which is an olefin, a vinyl or allyl ester of an aliphatic straight or branched chain acid, a vinyl ether whose alkyl radical has at least 4 carbon atoms, an allyl ether whose alkyl radical has at least 4 carbon atoms and/or a vinyl halide with b) an organopolysiloxane which contains hydrogen atoms bonded to silicon atoms, the addition product containing on average more than 7 carbon atoms in the alkyl radical and at least 0.20 mole of the unsaturated component a) per gram atom of hydrogen in the siloxane component b).

9 Claims, No Drawings

METHOD TO MAKE FIBROUS MATERIAL OIL AND WATER REPELLENT AT THE SAME TIME

This invention relates to a process for simultaneously rendering fibre materials oil-repellent and water-repellent.

BACKGROUND TO THE INVENTION

When homopolymers or copolymers with a plurality of perfluoralkyl groups are applied to fibre materials from an aqueous emulsion they impart good oil-repellent effects to the materials. However, these products are only of limited suitability for simultaneously making the fibre materials water-repellent. Consequently, emulsions of water-repelling agents are usually employed together with the fluorine-containing homopolymers or copolymers. Examples of such water-repelling agents, which are also referred to as extenders, are zirconium/paraffin emulsions and more particularly emulsions of fat-modified synthetic resins. In association with the fluorine-containing polymers, these extenders provide fibre materials with a good oil-repellent and water-repellent effect. Unfortunately the handle of the treated fibre materials is not good since it is too stiff and too dry.

Conventional products based on silicones are completely unsuitable as extenders since, although they impart a pleasingly soft handle with smooth surface, these products, already in a low concentration, greatly reduce the oil repellency or in some cases the oil-repellent effect is completely lost.

An attempt therefore has now been made and it forms an object of this invention to find an extender which provides the pleasing "silicone handle" and also produces a good water repulsion, without at the same time having a negative influence on the oleophobic effects or oil repellency of the treated fibre material.

THE INVENTION

According to the invention there is provided a process for simultaneously imparting oil-repellency and water-repellency to fibre materials in which the fibre materials are impregnated with a liquor containing homopolymer and/or copolymer having a plurality of perfluoralkyl groups of at least 4 carbon atoms per alkyl group and as extender, an addition product of a) an unsaturated compound which is an olefin, a vinyl or allyl ester of an aliphatic straight- or branched-chain acid, a vinyl ether whose alkyl radical has at least 4 carbon atoms, an allyl ether whose alkyl radical has at least 4 carbon atoms, and/or a vinyl halide with b) an organopolysiloxane which contains hydrogen atoms bonded to silicon atoms, the addition product containing on average more than 7 carbon atoms in the alkyl radical and at least 0.20 mole of unsaturated component a) per gram atom of hydrogen in the siloxane component b), and thereafter the impregnated fibre materials are dried and heated.

The resulting treated fibre materials have good oil and water repellency and a good handle.

The homopolymers and copolymers having a plurality of perfluoralkyl groups with at least 4 carbon atoms which can be used are known. Examples are described in U.S. Pat. No. 2,642,416. In that patent are described aqueous dispersions of homopolymers or copolymers of 1,1-dihydroperfluoalkyl acrylates. In addition, for producing the oil-repellent effect, there can be used aqueous dispersions of homopolymers or copolymers of monomers of the general formula: $R^fSO_2N(R') - R - CH_2OZ$, in which $R^f$ represents a perfluoalkyl group with at least 4 carbon atoms, R' represents a hydrogen atom or alkyl group with 1 to 6 carbon atoms, R represents a divalent aliphatic hydrocarbon radical with 1 to 12 carbon atoms and Z represents an acrylic or methacrylic acid radical (see for example U.S. Pat. No. 2,803,615). Other suitable homopolymers and copolymers are of monomers of the general formula: $R^fSO_2N(R') - R - COOX$, in which $R^f$, R' and R are as defined above and X represents a polymerizable radical, such as an allyl, methallyl or vinyl radical, used in the form of aqueous dispersions. Finally, as an example of polymers having an oleophobic effect, there are those which contain monomers of the general formula:

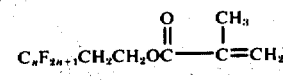

in which $n$ is an integer from 3 to 14 (see for example British patent specification No. 971,732). Organic solutions of all these various polymers can also be used, these solutions being prepared in known manner.

Examples of organopolysiloxanes containing hydrogen atoms bonded to silicon are the known alkylhydrogen polysiloxanes, especially methyl- or ethyl-hydrogen polysiloxanes, methyl-hydrogen polysiloxanes being preferred. However, for producing the organopolysiloxanes, it is also possible for silanes, which contain a hydrogen atom bonded to silicon, to be jointly hydrolysed with silanes which do not contain any hydrogen atom bonded to silicon, and for the resulting co-hydrolysates which are obtained and which can also show a high degree of polymerization and thus have a high viscosity, to be employed for the production of the extenders used according to the invention. It is obviously also possible for other groups, e.g. aryl groups, to be included as well as the alkyl groups in the polysiloxanes which are employed. In this respect, also those compounds which additionally carry reactive terminal groups, such as hydroxyl groups, are suitable.

The unsaturated compounds used for the addition are olefines, more particularly $\alpha$-olefines, vinyl esters and allyl esters of aliphatic, straight-chain or branched-chain acids and/or vinyl ethers and allyl ethers with at least 4 carbon atoms in the alkyl radical. Moreover, vinyl halides can also be used for the addition. The unsaturated compounds with 4 to 7 carbon atoms in the alkyl radical cannot, however, in such a case be used alone for the production of the extenders employed according to the invention, since the oil-repellent effect is deleteriously affected when using these addition products. It is accordingly necessary, and certainly preferred, for these unsaturated compounds to be added together with unsaturated compounds which have a higher alkyl radical, more particularly an alkyl radical with 12 to 18 carbon atoms, so that, after the addition, alkyl radicals with on average more than 7 carbon atoms are added. It is obviously also possible to achieve good extenders if vinyl compounds with a relatively long alkyl radical, more particularly with 8 to 18 carbon atoms, alone are added. To be particularly emphasized as vinyl compounds are isobutyl vinyl ethers (when used in combination with vinyl compounds with a relatively long alkyl chain), alkyl vinyl ethers with 12 to 18 carbons atoms in the alkyl radical, such as octadecyl vinyl ether, vinyl esters of secondary and tertiary carboxylic acids with 9 to 11 carbon atoms (see the Journal "Seifen-Ole-Fette-Wachse", 88, page 438 (1962)) and α-olefines with 8 to 18 carbon atoms.

In order to obtain extenders which do not impair the oil-repellent effect and which provide the desirable good silicone handle, it is necessary to add at least 0.20 mole of the unsaturated component (a) per gram atom of hydrogen in the siloxane component (b), the products obtained after the addition containing on average more than 7 carbon atoms in the alkyl radical. Particularly preferred are those addition products in which 0.25 to 0.75 mole of component (a) is added per gram atom of hydrogen of siloxane component (b). If, as preferred, mixture of (1) vinyl compounds with 4 to 7 carbon atoms and (2) vinyl compounds with a relatively long alkyl radical, more particularly 12 to 18 carbon atoms are added, then 0.05 to 0.9 mole of the compound (1) and 0.1 to 0.75 mole of the compound (2) can be used, with the proviso that the sum of compounds (1) and (2) amounts to at least 0.20 and at most to 1.0 mole. The extenders produced by mixed addition are distinguished by a particularly good silicone handle, and here it is particularly advantageous to use addition products in which the molar quantity of compound (1) makes up at least the same, but advantageously twice to three times, the amount of the compound (2).

The addition of the unsaturated compound component a to the organopolysiloxane component b can be effected in substance in a manner known per se. By way of example, the procedure can be for the monomers compound component a to be mixed with the organopolysiloxane, for a part of this mixture to be initially supplied and heated and then, after adding a conventional catalyst, such as hexachloroplatinic acid in amount of about $5.10^{-2}$ to $5.10^{-4}$ g per mole of vinyl compound (larger quantities are introduced when working in a solvent and when using organopolysiloxane copolymers), for the reaction to be initiated. The addition proceeds in a strongly exothermic manner and the temperature is kept at 160° to 180° C, if necessary by cooling. The remainder of the mixture is allowed to run in until the reaction is complete, the mixture then being kept for a short time at the high temperature and the monomers which have not reacted being as far as possible distilled off under vacuum. After cooling the reaction mixture, the catalyst is inactivated by adding organic sulphur compounds, more particularly sulphoacids, sulpho-acid esters or mercaptans. The addition can also take place in the presence of relatively high boiling point solvents.

In order to prepare the addition products, it is also possible to proceed in such a way that initially the monomer components or component (a) are supplied and heated after addition of the catalyst which is preferably hexachloroplatinic acid dissolved in a suitable solvent, such as isobutanol. After this the organopolysiloxane component b) containing hydrogen atoms bonded to silicon is slowly added. The reaction is then carried out in a manner similar to that indicated above, at about 140° to 170° C, and a brief post-reaction is allowed to take place, whereafter the unreacted monomers are possibly distilled off under vacuum, the mixture is cooled, the catalyst is inactivated, in order to prevent an undesired cross-linking of the addition product, and usually a clear, highly viscous to waxy product is obtained.

When using vinyl compounds (1) and vinyl compounds (2) it is also possible for the monomers to be added one after the other in the relative proportions indicated. However, this is more complicated and consequently is not so suitable.

With relatively small batches or where the possibility exists of dissipating the heat of reaction, it is also possible for all initial compounds to be mixed together from the outset and for the reaction to be carried out in a manner similar to that indicated.

The addition products which are obtained are used in the form of aqueous emulsions or in organic solution.

The emulsions can be prepared in known manner. The addition products used according to the invention as extenders and in the form of a solution in an organic, water-insoluble solvent, e.g. tetrachlorethylene, trichlorethylene, higher benzine fractions, toluene, or mixtures of these solvents, are transformed with addition of emulsifiers into approximately 8 to 25% emulsions (calculated on addition product). Suitable emulsifiers are also known. Examples are polyvinyl alcohols in aqueous solution, ethoxylated fatty acid amides and ethoxylated fatty amines, also in the form of their salts with low molecular weight organic acids or mineral acids, as well as quaternary ammonium compounds, such as octadecyloxymethyl pyridinium chloride. These emulsifiers are used particularly for the emulsification of organopolysiloxanes (see for example German Pat. No. 1,060,347, German Auslegeschrift No. 1,052,943, German Offenlegungsschrift No. 1,917,701 and U.S. Pat. Nos. 3,320,197, 3,729,437 and 3,748,275). In addition, the quantities of emulsifiers used can vary within the conventional range, that is to say, from about 2 to 20, and more particularly 6 to 15, percent by weight, calculated on the addition product.

The treatment of the fibre materials, to which the oil-repellent and water-repellent properties are to be imparted, can likewise be carried out in known manner. In general, of the aqueous emulsion of the fluorine-containing homopolymer or copolymer, which usually is present as a 20 to 35% emulsion, there are used 20 to 50 g/l. Approximately 30 to 70 g/l of the extender emulsion are likewise employed but the addition of a hardening catalyst is unnecessary. The fibre materials, advantageously textiles, are padded with the liquors to a liquor absorption of about 60 to 100%, briefly dried at 80° to 110° C and condensed for a few minutes, more particularly 3 to 8 minutes, at about 130° to 170° C. Other methods of application, such as spraying or kissing are also suitable, it being necessary for the quantities used to be varied according to the liquor absorption.

The emulsion of the homopolymer and copolymer and the extender emulsion can be kept separate and mixed in quantities indicated when the finishing liquor is to be prepared. However, it is also possible and particularly advantageous for reasons of simplified storage, for the two emulsions to be mixed from the outset in the required ratio, usually in the ratio of 1 part of the polymer emulsion to approximately 1.4 to 2 parts of the extender emulsion, and then for that emulsion to be stored and used in suitable quantities when the finishing liquor is to be prepared. The finishing can then be carried out in known manner.

The preparation of the one-component product is in such a case possible in a simple manner by the extender emulsion being prepared as described above, whereafter the prepared emulsion of the fluorine-containing polymer is introduced in the appropriate quantity.

As already indicated above, use in a solvent is also possible. For this purpose, the fluorine-containing hompolymers or copolymers are dissolved after precipitation in solvents such as methylethylketone and butylacetate, then diluted with water-insoluble solvents, the extender solution is added, employing quantities corresponding to the use in aqueous medium, and the fibre materials are treated in known manner, by for example, immersion and squeezing (wringing), or spraying.

Other auxiliaries which are usual in the textile industry can be added to the finishing bath liquor. Particular examples are agents with which crease resistance can be improved. However, it is possible to add filler resins and flame-proofing agents, together with the associated catalyst. When, however, the fibre materials are treated with solutions in a solvent, only those products of appropriate solubility can of course be added.

By means of the process according to the invention, fibre materials of all types can be simultaneously given an oil-repellent and water-repellent finish. Examples of fibre materials which can be treated are textiles, and in particular those which consist of cellulose fibres or consist at least in part of cellulose fibres. To be considered as mixed fibres in this connection are both man-made fibres, such as polyester, polyamide or polyacrylonitrile fibres, and also natural fibres such as wool. The process according to the invention can, however, also be used for the finishing of materials consisting of purely man-made fibres and wool fibres.

An advantage of the invention is that, when using the said addition products as extenders, it is possible for the fibre materials to be given an excellent, soft, surface-smooth handle, i.e. the typical silicone handle, as well as a very good water-repellent and oil-repellent finish. It thus becomes possible by the process of the invention to combine all the advantages of an oil-repellent finish which can be obtained with fluorine-containing polymers and of a water-repellent finish which can be obtained with silicones, which was not to be expected in accordance with prior art. It is particularly advantageous that the oil-repellent and water-repellent effects which are obtained are to a high degree resistant to washing and cleaning.

Another advantage of the process according to the invention is that the finishing is successfully achieved without concurrent use of a hardening agent. As shown by tests, it is in fact not possible to achieve any improvement in the oil- and water-repellent properties by using conventional hardening agents, and this has to be considered as surprising. However, due to the fact that there are no hardening agents in the liquor, it is possible in a particularly simple manner to add other finishing agents without significant danger of one deleteriously affecting the other.

The addition products can be prepared as follows:

A 1. 300 g of methyl hydrogen polysiloxane consisting of units of the formula —Si($HCH_3$)—O— (viscosity 30 cP at 20° C), 1.5 mole of vinyl isobutyl ether and 0.5 mole of vinyl octadecyl ether were mixed in a one liter vessel. 125 g of the mixture were placed in a 1 liter, three-necked spherical flask, equipped with a stirrer, thermometer, reflux condenser and supply vessel, and heated to 65° to 75° C. After removing the source of heat, 0.3 ml of hexachloroplatinic acid solution (0.5% in isobutanol) were added to the mixture, whereupon a strongly exothermic reaction and foaming of the reaction product occured. The temperature of the contents of the flask rose as a result to 170° to 180° C. Thereafter, the remainder of the mixture was added from the supply vessel over a period of about 1 hour, during which time a temperature of 160° C was to be maintained.

The mixture was then kept for another 30 minutes at 140° C, a water jet vacuum was applied to remove residual monomers and stirring continued for another hour at this temperature. After cooling the mixture to 80° C, 0.6 g of an inactivator for the catalyst (propyleneoxide glycerine adduct esterified with thioglycolic acid and of the molecular weight of about 4000) was added and the flask contents cooled under vacuum to 20° C.

A viscous, slightly cloudy, light-coloured product was obtained, which had a viscosity of about 600 cP (measured with measuring element 2 of the Epprecht viscosimeter) and an alkaline hydrogen cleavage of about 132 ml/g.

A 2. An addition product similar to that prepared in A 1 was produced, using 2.5 mole of the vinyl isobutyl ether and 2.5 mole of the vinyl octadecyl ether.

A 3. An addition product similar to that prepared in A 1 was produced using 2.5 mole of the vinyl isobutyl ether and 0.8 mole of the vinyl octadecyl ether.

A 4. An addition product similar to that prepared in A 1 was produced using 0.5 mole of the vinyl isobutyl ether and 0.75 mole of the vinyl octadecyl ether.

B. 1.4 mole of a vinyl ester of a synthetic fatty acid (about 10% secondary acid and about 90% tertiary acid with on average 10 carbon atoms; saponification number of the acids about 300) and 0.8 ml of the 0.5% hexachloroplatinic acid solution used in A 1 were placed in a three-necked spherical flask similar to that described in A 1 above. After heating to 100° C, 148 g of ethyl hydrogen polysiloxane (viscosity 42 cP at 20° C) were slowly introduced from the supply vessel. The temperature rose to 150° C and this temperature was maintained during the supply operation. After all the polysiloxane had been added, stirring was continued for 1 hour at 150° C, whereafter the contents were cooled to 60° C, 0.5 g of activator as in A 1 was added and the mixture cold stirred. A light-coloured, highly viscous addition product was formed.

C. 60 g of a methyl hydrogen polysiloxane (viscosity 40 cP at 20° C), 20 g of $\alpha$-olefine (with on average 6 to 8 carbon atoms; molecular weight about 100) and 0.2 mole of vinyl octadecyl ether were mixed in a 500 ml three-necked spherical flask equipped as in A 1 and heated to 65° to 70° C. After adding 0.5 ml of hexachloroplatinic acid solution, the temperature rose to approximately 140° C. Stirring was continued for another 20 minutes at this temperature, followed by cooling, and 0.2 g of the sulphur compound mentioned in A 1 added as inactivator. The end product was clear and had a viscosity of about 450 cP.

D. 0.5 mole of octadecyl vinyl ether were introduced instead of the monomer mixture mentioned in C and in addition the methyl hydrogen polysiloxane was replaced by 110 g of a methyl hydrogen polysiloxane (ratio 1:3 between the hydrogen atoms bonded to Si and methyl groups; viscosity 200 cP at 20° C). After cooling a soft waxy addition product was obtained.

E. 66 g of a 42% solution of a silicone polymer in ethyl acetate/xylene 1:1 (the solution providing alkaline cleavage of about 70 ml/g of hydrogen and having a viscosity of 4500 cP at 25° C as measured with measuring element 2 of the Epprecht viscometer and having besides methyl groups, 2% of phenyl groups) and 100 g of tetramethyl benzene with amounts of trimethyl benzene (boiling point about 182° C) were placed in a 500 ml three-necked spherical flask, equipped with a stirrer, thermometer, dropping funnel and distillation condenser with a vacuum connection and a preliminary flask. The solvents, ethyl acetate and xylene, were substantially completely distilled off while stirring constantly under a weak vacuum at about 130° C. The apparatus was ventilated and the distillation condenser was replaced by a reflux condenser. About 15 g of an α-olefine (with on average 16 carbon atoms and a molecular weight of about 224) and 0.3 ml of the catalyst solution were then added.

As a result of the addition reaction which took place, the temperature rose to 150 to 160° C and was kept in this range for about 20 minutes. The mixture was next allowed to cool under gentle vacuum, an inactivating agent for the catalyst as described in A 1 was added at about 80° C and finally the mixture was cooled to room temperature. An addition product solution was obtained which could be directly emulsified.

An aqueous emulsion of the addition products prepared according to A 1 to E can be prepared as follows:

40 g of a 25% solution of octadecyl oxymethyl pyridinium chloride were mixed with 10 g of an emulsifier of the formula:

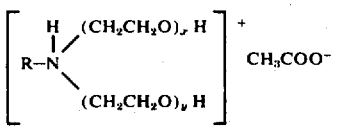

where R was on average 16 carbon atoms and $x + y$ was 10, and diluted with 200 ml of water and a solution of 120 g of an addition product as prepared in A 1 to D above in 160 g of tetrachlorethylene (of the solution according to E 400 g were directly introduced) was slowly stirred in. The solution was then homogenised at 20° C and 250 atmosphere on a high-pressure homogenising machine. The quantity is then made up with water to 1000 g.

It is also possible for the emulsifier mixtures to use very different emulsifiers and naturally also for more dilute and more concentrated emulsions of the addition products to be prepared.

DESCRIPTION OF PRESENTLY PREFERRED EMBODIMENTS OF THE INVENTION

The invention will now be illustrated by the following Examples.

EXAMPLE 1

A cotton poplin woven fabric (weight per square meter 160 g) was impregnated with a liquor containing 30 g/l of the copolymer emulsion prepared according to Example 8 of U.S. Pat. No. 2,803,615, 50 g/l of a 48% aqueous aminoplast resin solution (mixture of dimethylol ethylene urea and pentamethylol melamine etherified with methanol, in the ratio by weight of 7:3), 5 ml/l of a 30% zinc nitrate solution (pH value about 1, adjusted with hydrochloric acid) and 50 g/l, in turn, of one of the extender emulsions prepared according to methods A 1 to A 4, wrung out to 70% liquor absorption dried at 100° C and condensed for 5 minutes at 150° C to give finished poplins referred to hereinafter as finishes A 1 to A 4.

For comparison purposes, the same poplin was treated in the same manner, but using as extender, in one case, 50 g/l of an aqueous emulsion of a fat-modified melamine resin (12%) prepared according to Example 1 of U.S. Pat. No. 3,506,661 and octadecyl oxymethyl pyridinium chloride (1.5%) as emulsifier and in the other case 50 g/l of a likewise 12% polysiloxane emulsion (dimethylpolysiloxane of viscosity 750 cP and methyl hydrogen polysiloxane of viscosity 30 cP in the ratio of 80:20; prepared in a manner similar to methods A 1 to A 4) and the finished poplins are referred to hereafter as finishes B and C, respectively.

The properties of the finished poplins are set out in the following Table in which the tests for water absorption and for the water bead-forming effect were carried out according to DIN 53 888, while the oil-repellent effect was established in accordance with AATCC 118 - 1966 T.

| | Rain test | | | |
|---|---|---|---|---|
| Finish | water absorption in % | water bead-forming effect | Oil repulsion | Handle |
| A 1 | 8 | 4-4-4 | 5 | excellent silicone handle |
| A 2 | 6 | 5-5-5 | 5 | very good silicone handle |
| A 3 | 9 | 4-4-4 | 5 | good silicone handle |
| A 4 | 9 | 4-4-4 | 4 | good silicone handle |
| B (prior art) | 8 | 5-5-5 | 5 | stiff, dry handle |
| C | 10 | 4-4-4 | 0 | excellent silicone handle |

As can be seen, the finishes A 1 to A 4 according to the invention gave excellent water- and oil-repellencies and also a good handle.

EXAMPLE 2

A polyester-cotton woven fabric 35/65 (weight per square meter 133 g), a polyamide-cotton woven fabric 20/80 (weight per square meter 112 g) and a polyester woven fabric (weight per square meter about 260 g) were impregnated with the following treating liquor:

40 g/l of the polymer emulsion which is described in Example III of British patent specification No. 971,732, 50 g/l of the extender emulsion prepared by using the product of method B above (content of addition product 15%), 22 g/l of dimethylol dihydroxyethylene urea (in the form of a 44% aqueous solution) and 2.5 g/l of zinc nitrate hexahydrate. The woven fabric was then wrung out to a liquor absorption of 65 to 75% dried at 110° C and condensed for 6 minutes at 155° C. The finished materials had a very good water-repulsion. The oil-repulsion was also excellent. The finished specimens were in addition characterised by a soft, smooth handle.

EXAMPLE 3

A cotton woven fabric (weight per square meter 170 g) was impregnated with a liquor which contained 25 g/l of the polymer emulsion prepared in Example 3 of U.S. Pat. No. 2,803,615, 40 g/l of an extender emulsion (12%) prepared by using the product of method C above, as well as 30 g/l of pentamethylol melamine trimethyl ether (in the form of a 60% aqueous solution) and 5 ml/l of a 30% zinc nitrate solution (pH about 1 adjusted with hydrochloric acid) wrung out to a liquor absorption of about 70%, briefly dried at 100° C and condensed for 5 minutes at 155° C. The fabric thus treated had a very good water-repulsion a good water bead-forming effect, excellent oil-repulsion and pleasing soft handle.

EXAMPLE 4

When the particular extender emulsion was replaced by 60 g/l of an extender emulsion prepared by using the product of method E above, equally good results were given.

EXAMPLE 5

Using a treatment liquor which contained 30 g/l of of the polymer emulsion mentioned in Example 1 and 50 g/l of the extender emulsion (14%) prepared by using the product of method D above, a woven polyamide fabric (weight per square meter 75 g) was impregnated, wrung out to 65% liquor absorption dried at 110° C and condensed for 7 minutes at 145° C. The treated fabric had a good oil- and water-repulsion and an excellent handle.

EXAMPLE 6

The copolymer emulsion referred to in Example 2D of U.S. Pat. No. 3,068,187 was mixed while stirring with about three times its volume of isopropanol, the precipitated polymer was filtered off and dried under vacuum. The product thus prepared was subsequently dissolved in benzene to give an 8% solution.

A cotton poplin (weight per square meter 160 g) was impregnated with a finishing bath which contained 90 g of the benzene polymer solution prepared as described above and 6 g of the product of method B above, (dissolved in 50 g of tetrachloethylene) per liter of tetrachlorethylene, wrung out to about 100% liquor absorption, dried and condensed for 5 minutes at 155° C. Good values as regards oil-repulsion and water-repulsion were obtained. Also the handle was soft with a smooth surface.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What we claim is:

1. A process for simultaneously imparting oil-repellency and water-repellency to fibre materials in which the fibre materials are impregnated with a liquor containing a homopolymer, a copolymer or a mixture thereof, having a plurality of perfluoroalkyl groups of at least 4 carbon atoms per alkyl group and a water-repellent agent as extender, dried and heated, the improvement comprising that as extender is used an addition product of (a) an unsaturated compound which is an olefin selected from the group consisting of a vinyl or allyl ester of an aliphatic straight- or branched-chain acid, a vinyl-alkyl ether whose alkyl radical has at least 4 carbon atoms, and allyl-alkyl ether whose alkyl radical has at least 4 carbon atoms, a vinyl halide and mixtures thereof with (b) an organopolysiloxane which contains hydrogen atoms bonded to silicon atoms, the addition product containing on average more than 7 carbon atoms in the alkyl radical and at least 0.20 mole of unsaturated component (a) per gram atom of hydrogen in the siloxane component (b).

2. A process according to claim 1 wherein component (b) is a methyl hydrogen polysiloxane.

3. A process according to claim 1 wherein the addition products contain 0.25 to 0.75 mole of the unsaturated component (a) per gram atom of hydrogen in the siloxane component (b).

4. A process according to claim 1 wherein the unsaturated component (a) contains 8 to 18 carbon atoms.

5. A process according to claim 1 wherein each mole of the unsaturated component (a) is a mixture of (1) from 0.05 to 0.9 mole of a vinyl compound with 4 to 7 carbon atoms in its alkyl radical and (2) 0.1 to 0.75 mole of a vinyl compound with 12 to 18 carbon atoms in its alkyl radical.

6. A process according to claim 5 wherein the molar proportion of compound (1) is at least equal to the molar proportion of compound (2).

7. A process according to claim 1 wherein the same is carried out in an aqueous emulsion.

8. A process according to claim 7 wherein the extender is 30 to 70 g/l of an 8 to 25% emulsion of the addition product.

9. The fibre material treated according to the process of claim 1.

* * * * *